US008298203B2

(12) United States Patent
Motsch et al.

(10) Patent No.: US 8,298,203 B2
(45) Date of Patent: Oct. 30, 2012

(54) MULTI-PRESENTATIONAL PACKAGING FOR DISPOSABLE DIAPERS

(75) Inventors: Andreas Peter Motsch, Waldems (DE); Beate Christine Janik, Kelkheim (DE); Martin Werner Frank, Bad Vilbel (DE)

(73) Assignee: The Procter & Gamble Company, Cincinnati, OH (US)

( * ) Notice: Subject to any disclaimer, the term of this patent is extended or adjusted under 35 U.S.C. 154(b) by 1330 days.

(21) Appl. No.: 11/074,103

(22) Filed: Mar. 7, 2005

(65) Prior Publication Data

US 2006/0196797 A1 Sep. 7, 2006

(51) Int. Cl.
*A61F 13/15* (2006.01)
*A61L 15/00* (2006.01)

(52) U.S. Cl. ..... 604/385.02; 604/385.01; 206/440

(58) Field of Classification Search ..... 604/385.02, 604/385.01; 206/440, 449, 494
See application file for complete search history.

(56) References Cited

U.S. PATENT DOCUMENTS

| | | | | |
|---|---|---|---|---|
| 4,940,464 | A | 7/1990 | Van Gompel et al. | |
| 5,048,687 | A | 9/1991 | Suzuki et al. | |
| 5,092,861 | A | 3/1992 | Nomura et al. | |
| 5,246,433 | A | 9/1993 | Hasse et al. | |
| 5,361,905 | A * | 11/1994 | McQueeny et al. | 206/494 |
| 5,569,234 | A | 10/1996 | Buell et al. | |
| 5,897,545 | A | 4/1999 | Kline et al. | |
| 5,957,908 | A | 9/1999 | Kline et al. | |
| 6,120,487 | A | 9/2000 | Ashton | |
| 6,120,489 | A | 9/2000 | Johnson et al. | |
| 6,318,555 | B1 * | 11/2001 | Kuske et al. | 206/494 |
| 6,884,238 | B2 * | 4/2005 | Underhill et al. | 604/385.01 |
| 2003/0155266 | A1 | 8/2003 | Andersen et al. | |
| 2003/0233082 | A1 | 12/2003 | Kline et al. | |
| 2003/0234199 | A1 | 12/2003 | Morita et al. | |
| 2004/0134822 | A1 | 7/2004 | Otsubo | |
| 2005/0121348 | A1 | 6/2005 | Clare et al. | |

FOREIGN PATENT DOCUMENTS

DE 92 18 468 U1 5/1994

OTHER PUBLICATIONS

International Search Report Jul. 25, 2006.

* cited by examiner

*Primary Examiner* — Jacqueline F. Stephens
(74) *Attorney, Agent, or Firm* — Charles R. Ware

(57) ABSTRACT

A multi-presentational package for disposable diapers such that the package may be presented in a multi-package form or an individual-package form. One exemplary embodiment of the package may include a plurality of disposable diaper products, a plurality of stabilizers, and a wrapping layer. The multi-presentational package may be marketed as a single unit such that a substantial portion of said plurality of disposable diaper products is visible to the consumer and/or the plurality of disposable diaper products and plurality of stabilizers may be removed from said multi-presentation package and subsequently marketable as multiple units.

16 Claims, 4 Drawing Sheets

MULTI-PRESENTATIONAL PACKAGING FOR DISPOSABLE DIAPERS

FIELD OF THE INVENTION

This invention relates to multi-presentational packaging for disposable diapers such that said package may be presented in a multi-package form or an individual-package form.

BACKGROUND OF THE INVENTION

Consumer products are commonly sold in retail stores that market such products by placing them on store shelves. Many consumer products are free-standing (e.g., cereal boxes, cans of soup) such that they do not require a support apparatus to be placed on a shelf. Other consumer products, however, are not substantially free-standing. Of these non-substantially-free-standing products, some of them require a particular orientation on the shelf (e.g., packages that have oriented surface indicia). One particular example of interest is disposable diapers.

Many disposable diapers are packaged in flexible film (e.g., low density polyethylene). Once packaged, the resulting package shape is generally rectangular in shape. Such rectangular shapes typically have a larger front and rear surface which provides the most surface area for the placement of surface indicia (e.g., graphics, text, pictures). However, basic scientific principles (e.g., center of gravity) dictate that the rectangular shape package is most stabile when placed on one of these larger surfaces. Thus, the surface indicia is not seen by the consumer, especially when one package is stacked on top of another. If the consumer can not find their desired product on the shelf amongst a multitude of stacked packages, then the consumer is unlikely to purchase your product. Furthermore, when the consumer searches through the several stacks, they are more likely to mix the product versions with one another. In addition to the consumer's frustrations, the store clerk has similar difficulties when attempting to determine reorder amounts and proper product placement.

In addition to the problems of upright stability, the retailing of disposable diaper packages presents other challenges. For instance, typically disposable diapers are shipped in large cardboard boxes from the manufacturer to the various retailers. Some of these retailers have large store shelves for the marketing of these large cardboard boxes such that the individual diapers are not removed from said boxes by the retailer. Such retailers are hereinafter referred to as "club stores". While the selling of large cardboard boxes often provides cost-related benefits, cardboard box side surfaces often do not include aesthetically-pleasing advertising. In addition, providing aesthetically-pleasing printing on the cardboard box would significantly increase costs, particularly since printing on most cardboard boxes usually includes only a few ink colors. Further, given that cardboard boxes are opaque, they do not permit the consumer to immediately recognize the printed graphics on the diapers which is a major consideration for the wearer. Unlike club stores, however, some retailers have minimal store shelf space and thus remove the individual packages of diapers from said cardboard boxes for subsequent sale. Such retailers are hereinafter referred to as "conventional stores". While the individual retailing of disposable diapers provides for aesthetically-pleasing advertising, said diapers often incur the upright stability issues discussed above.

What is needed is multi-presentational packaging for disposable diapers such that said package may be presented in either a multi-package form for club stores while still providing aesthetically-pleasing advertising or a single-package form for conventional stores while still providing upright stabile packages.

SUMMARY OF THE INVENTION

A multi-presentational package for disposable diapers such that the package may be presented in a multi-package form or an individual-package form. One exemplary embodiment of the package may include a plurality of disposable diaper products, a plurality of stabilizers, and a wrapping layer. The stabilizer may include a front panel which is oriented substantially vertical. The front panel may include an outward-facing surface and an inward-facing surface. The outward-facing surface is positioned away from said plurality of disposable diaper products and of sufficient size to accommodate communication being placed thereon. The inward-facing surface is positioned towards said plurality of disposable diaper products. The front panel may also include a top end and a bottom end. The stabilizer may also include a bottom panel which is oriented substantially horizontal. The bottom panel may include a downward-facing surface and an upward-facing surface. The upward-facing surface is positioned towards said plurality of disposable diaper products. The upward-facing surface being of sufficient rigidity to provide substantial support of said plurality of disposable diaper products. The downward-facing surface is positioned away from said plurality of disposable diaper products. The bottom panel may also include a front end and a rear end, wherein the front end may be joined to the bottom end of the front panel. The stabilizer may also include a rear panel which is oriented substantially vertical. The rear panel may include an outward-facing surface and an inward-facing surface. The outward-facing surface is positioned away from said plurality of disposable diaper products. The inward-facing surface is positioned towards said plurality of disposable diaper products. The rear panel may also include a top end and a bottom end wherein the bottom end may be joined to the rear end of the bottom panel. The wrapping layer may substantially surround the plurality of disposable diaper products. The package may also include a support member for added upright stabilizing support such as a top support member.

In another exemplary embodiment, the stabilizer may include a circumferential sleeve which is oriented substantially vertical. The circumferential sleeve may include an outward-facing surface and an inward-facing surface. The outward-facing surface is positioned away from the disposable diaper product. The outward-facing surface being of sufficient size to accommodate communication being placed thereon. The inward-facing surface is positioned towards the disposable diaper product. The circumferential sleeve may also include a top end and a bottom end. The circumferential sleeve may also include a bottom panel which is oriented substantially horizontal. The bottom panel having a downward-facing surface and an upward-facing surface. The upward-facing surface is positioned towards the disposable diaper product. The upward-facing surface being of sufficient rigidity to provide substantial support of the disposable diaper product. The downward-facing surface is positioned away from the disposable diaper product. The bottom panel may be joined to the circumferential sleeve.

The multi-presentational package may be marketed as a single unit such that a substantial portion of said plurality of disposable diaper products is visible to the consumer and/or the plurality of disposable diaper products and plurality of stabilizers may be removed from said multi-presentation package and subsequently marketable as multiple units.

BRIEF DESCRIPTION OF THE DRAWINGS

While the specification concludes with claims particularly pointing out and distinctly claiming the subject matter that is regarded as the present invention, it is believed that the invention will be more fully understood from the following description taken in conjunction with the accompanying drawings. None of the drawings are necessarily to scale.

DETAILED DESCRIPTION OF THE INVENTION

Figure 1:
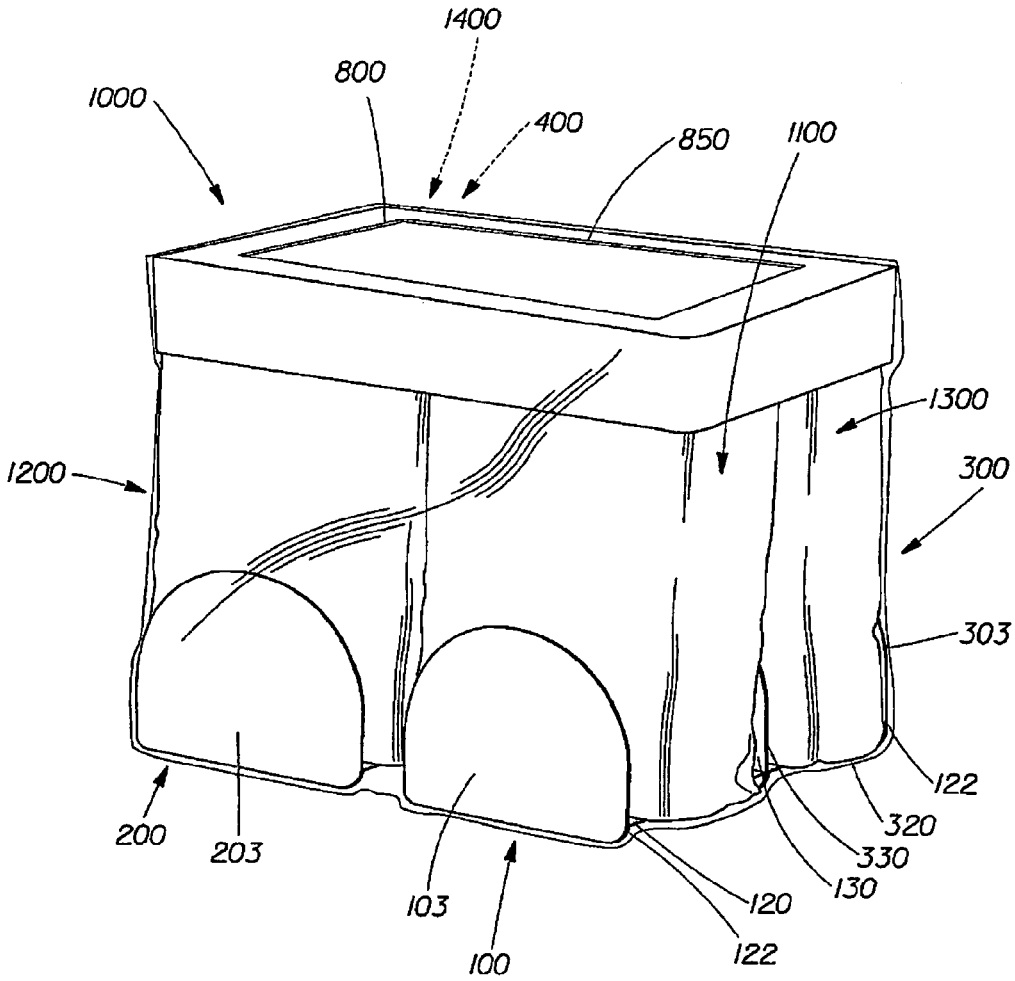
FIG. 1 is a perspective view of an exemplary multi-presentational package of disposable diapers in accordance with the present invention.

Definitions:

The term "disposable" is used herein to describe absorbent articles which generally are not intended to be laundered or otherwise restored or reused as absorbent articles (i.e., they are intended to be discarded after a single use and, preferably, to be recycled, composted or otherwise discarded in an environmentally compatible manner).

The term "diaper" herein refers to an absorbent article generally worn by infants and incontinent persons about the lower torso.

The term "absorbent article" herein refers to devices which absorb and contain body exudates and, more specifically, refers to devices which are placed against or in proximity to the body of the wearer to absorb and contain the various exudates discharged from the body. Said absorbent article may have an absorbent core having a garment surface and a body surface; a liquid permeable topsheet positioned adjacent said body surface of said absorbent core; and a liquid impermeable backsheet positioned adjacent said garment surface of said absorbent core.

The term "pant", as used herein, refers to disposable absorbent articles having a waist opening and leg openings designed for infant or adult wearers. A pant may be placed in position on the wearer by inserting the wearer's legs into the leg openings and sliding the pant into position about the wearer's lower torso. A pant may be preformed by any suitable technique including, but not limited to, joining together portions of the article using refastenable and/or non-refastenable bonds (e.g., seam, weld, adhesive, cohesive bond, fastener, etc.). A pant may be preformed anywhere along the circumference of the article (e.g., side fastened, front waist fastened). While the term "pant" is used herein, pants are also commonly referred to as "closed diapers", "prefastened diapers", "pull-on diapers", "training pants" and "diaper-pants". Suitable pants are disclosed in U.S. Pat. No. 5,246,433, issued to Hasse, et al. on Sep. 21, 1993; U.S. Pat. No. 5,569,234, issued to Buell et al. on Oct. 29, 1996; U.S. Pat. No. 6,120,487, issued to Ashton on Sep. 19, 2000; U.S. Pat. No. 6,120,489, issued to Johnson et al. on Sep. 19, 2000; U.S. Pat. No. 4,940,464, issued to Van Gompel et al. on Jul. 10, 1990; U.S. Pat. No. 5,092,861, issued to Nomura et al. on Mar. 3, 1992; U.S. patent application Ser. No. 10/171,249, entitled "Highly Flexible And Low Deformation Fastening Device", filed on Jun. 13, 2002; U.S. Pat. No. 5,897,545, issued to Kline et al. on Apr. 27, 1999; U.S. Pat. No. 5,957,908, issued to Kline et al on Sep. 28, 1999.

The term "machine direction (MD)" or "longitudinal" herein refers to a direction running parallel to the maximum linear dimension of the article and/or fastening material and includes directions within ±45° of the longitudinal direction.

The term "cross direction (CD)", "lateral" or "transverse" herein refers to a direction which is orthogonal to the longitudinal direction.

The term "joined" encompasses configurations whereby an element is directly secured to another element by affixing the element directly to the other element, and configurations whereby an element is indirectly secured to another element by affixing the element to intermediate member(s) which in turn are affixed to the other element. The term "babies" ("baby" in singular) is intended to describe persons ranging in age from newborn to about 2-7 years old. Young children often referred to variously as toddlers, pre-school aged children, or even school aged children all come within this definition. It is specially contemplated that the definition of babies as used herein will encompass children of an age who can talk and have greater dexterity, motor skills and the like than younger babies (for example, as compared to newborn babies). Such older babies (as the term is used herein) may be able to use baby wet wipes products themselves while younger babies may need a caregiver to use the product on them. There is no single upper age limit for babies (as that term is used herein) and it will be recognized that babies progress through stages of development at differing rates. The characteristics of the stages and situations (described in greater detail below) may be more significant than the typical age ranges associated with such stages and situations. Age ranges are by necessity averages and generalities. The ability of the line ups of the present invention to target on the basis of situation and stage (as determined without strict reference to age) is one of its benefits. While no particular upper age limit exists for babies, it is typical that those making the ultimate purchase decision with respect to particular products in the line up will not be a baby within the meaning defined above. In other words, even though older babies may be involved in the use and purchase of baby wipes for their stage or use situation, they often will not make the entire purchase decision on their own (as an example, a 5 year old might tell his or her parent what product he or she desires, but ultimately the parent makes the decision to purchase or not).

Description

FIG. 1 shows an exemplary multi-presentational package 1000 for the storing of disposable diapers. More specifically, said multi-presentational package 1000 may comprise of a stabilizers (herein, 100, 200, 300, 400) a plurality of disposable diaper products (herein, 1100, 1200, 1300, 1400) and a wrapping layer 850. In this example, stabilizer 100 is shown having a front panel 103, a bottom panel 120 and rear panel 130. Stabilizer 300 is also shown having a front panel 303, a bottom panel 320 and a rear panel 330 being placed next to stabilizers 100 rear panel 130. In this way, a first disposable diaper product 1100 and a second disposable diaper product 1300 may be marketed in a rear-to-rear fashion. Further, in this example, stabilizer 200 is also shown having a front panel 203, being placed side-by-side to stabilizer 100 front panel 103 and rear-to-rear to stabilizer 400. By way of this construction, stabilizer 200 may also provide for the marketing of a third disposable diaper product 1200 and stabilizer 400 for the marketing of a fourth disposable diaper product 1400 in a rear-to-rear fashion. Given that disposable diaper products are often heavy, it may be desirable to provide standoffs for additional upright stability. In this example, stabilizer 100 has standoffs 122 positioned near the front and the rear of said stabilizer. Multi-presentational package 1000 may also include a wrapping layer 850 so as to provide circumferential support of a plurality of disposable diaper products. Wrapping layer 850 may include conventional shrink-wrap (e.g., flexible film such as polyethylene) or any other suitable material. Lastly, it may be desirable to include an additional support member for added upright stabilizing support. In this example, a top support member 800 serves as said additional support member. Said top support member 800 may be constructed of a cardboard material or any other suitable material. While not shown, one skilled in the art would appreciate that an additional support member may be provided in other ways including, but not limited to, a substantially vertical support member positioned interposed said disposable diaper products.

Referring still to FIG. 1, this multi-presentational package 1000 may be shipped in this manner from the manufacturer to the various retailers without the need of conventional cardboard boxes. Further, this multi-presentational package 1000 may be directly placed onto the shelves of club stores while still providing aesthetically pleasing advertising and immediate visual appreciation of the printed graphics on the disposable diapers. In addition to the aesthetic benefits of said multi-presentational package 1000, it has also been discovered that this unique construction may be stacked and warehoused much in the same way as conventional secondary packaging without the need for excessive cardboard material. Further, it has also been discovered that this unique construction allows warehouse personnel to quickly identify the desired disposable diaper needed for restocking of the store shelves.

Figure 2:
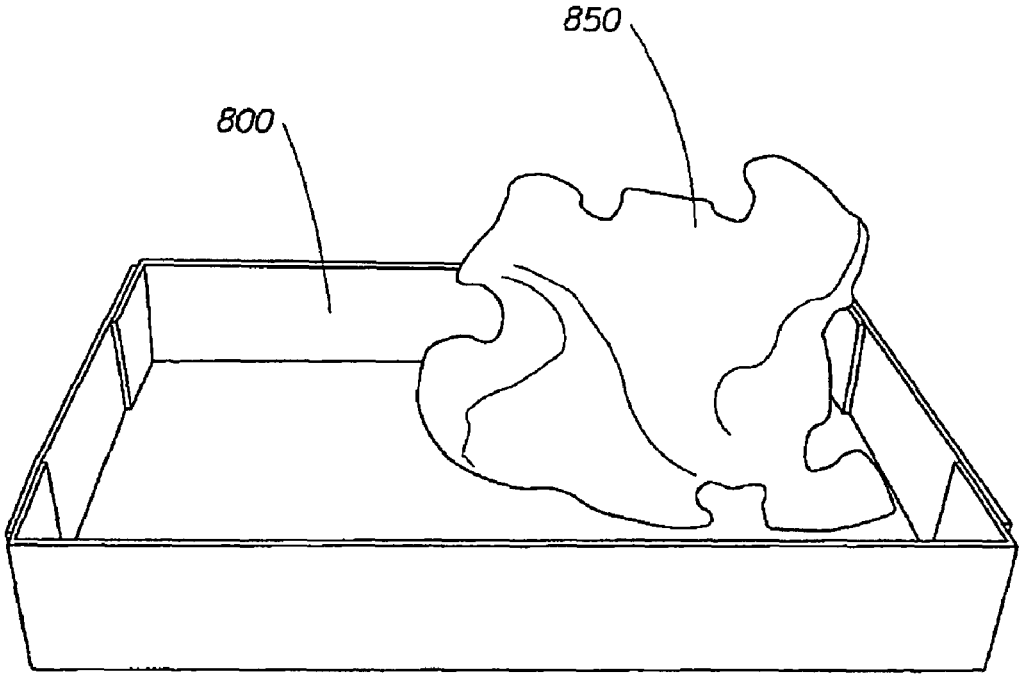
FIG. 2 is a perspective view of the top support member and wrapping layer having been removed from the multi-presentational package from FIG. 1.
Figure 3A:
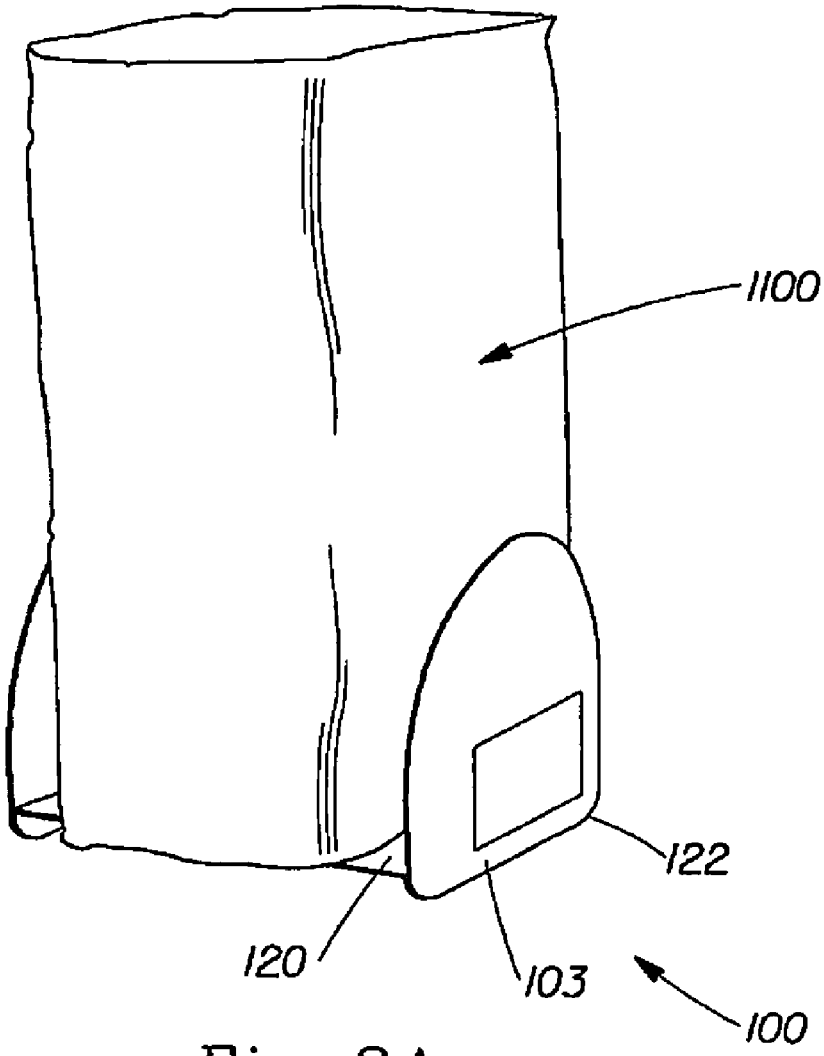
FIG. 3*a* is a perspective view of an exemplary individual-package of disposable diapers having been removed from the multi-presentational package from FIG. 1.
Figure 3B:
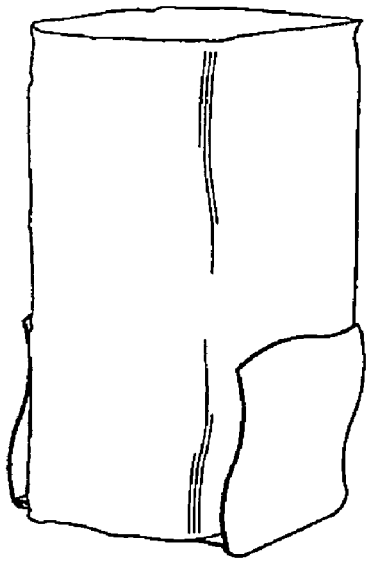
FIG. 3*b* is a perspective view of another exemplary individual-package of disposable diapers which could be removed from a multi-presentational package similar to that of the package from FIG. 1.
Figure 3C:
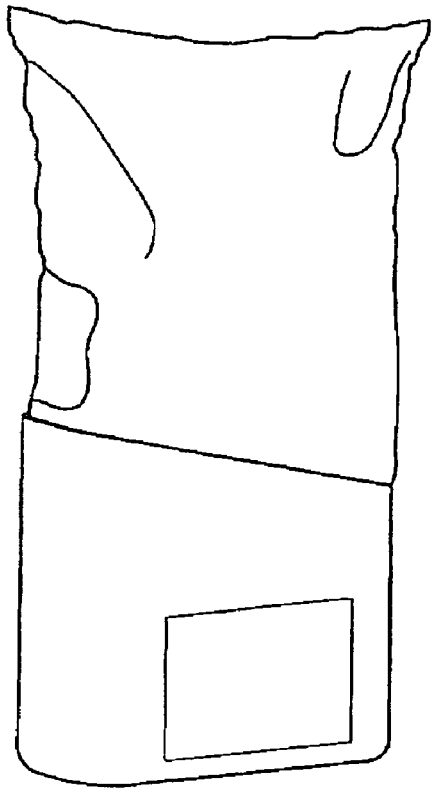
FIG. 3*c* is a perspective view of yet another exemplary individual-package of disposable diapers which could be removed from a multi-presentational package similar to that of the package from FIG. 1.

Referring now to FIG. 2, top support member 800 and wrapping layer 850 are shown having been removed from multi-presentational package 1000. These materials may be easily removed by the conventional store retailers in order to subsequently sell the disposable diaper products individually. In this way, FIG. 3*a* shows an exemplary individual-form of a disposable diaper product having been removed from said multi-presentational package 1000. As can be appreciated by this view, stabilizer 100 remains with first disposable diaper product 1100 so as to provide continued upright support for placement on the shelves of the conventional store retailers. While this particular example shows one disposable diaper product being sold as an individual-package, one skilled in the art would appreciate that any number of disposable diaper products may be combined and sold as individual units. For example, FIG. 3*b* shows another exemplary individual-package of disposable diapers which could be removed from a multi-presentational package similar to that of the package from FIG. 1. In yet another example, FIG. 3*c* shows yet another exemplary individual-package of disposable diapers which could be removed from a multi-presentational package similar to that of the package from FIG. 1. In this particular example, this sleeve-type stabilizer may be designed to provide circumferential, upright support of said single disposable diaper product.

All documents cited in the Detailed Description of the Invention are, in relevant part, incorporated herein by reference; the citation of any document is not to be construed as an admission that it is prior art with respect to the present invention.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A multi-presentational package comprising:

a plurality of product packages, wherein each of the product packages:

contains a plurality of disposable diapers;

has a substantially rectangular surface, with longer sides and shorter sides;

is printed with graphics; and is configured for retail sale as an individual unit; and a plurality of stabilizers, wherein each of the stabilizers includes a front panel, a bottom panel, and a rear panel, and each of the stabilizers supports a corresponding one of the product packages so that the longer sides are vertically oriented;

wherein the multi-presentation package is configured for retail sale as an individual unit.

2. The multi-presentational package of claim 1, wherein each of the stabilizers covers only a portion of the corresponding product package, leaving a substantial portion of the corresponding product package uncovered by the stabilizer.

3. The multi-presentational package of claim 1, including a wrapping layer, wrapped around the multi-presentational package, wherein the wrapping layer is configured so that a portion of the graphics of at least one of the product packages is visible from outside of the multipresentational package.

4. The multi-presentational package of claim 1, including a wrapping layer, wrapped around the multi-presentational package, wherein the wrapping layer is configured so that a substantial portion of at least one of the product packages is visible from outside of the multipresentational package.

5. The multi-presentational package of claim 1, including a wrapping layer, wrapped around the multi-presentational package, wherein the wrapping layer is configured so that a portion of each of the product packages is visible from outside of the multipresentational package.

6. The multi-presentational package of claim 1, including a wrapping layer, wrapped around the multi-presentational package, wherein the wrapping layer is configured so that a portion of the graphics of each of the product packages is visible from outside of the multipresentational package.

7. The multi-presentational package of claim 1, wherein each stabilizer includes at least one standoff.

8. The multi-presentational package of claim 1, wherein each stabilizer includes and open sides.

9. The multi-presentational package of claim 8, wherein at least one of the panels on at least one of the stabilizers includes an outward facing surface, which includes information about the corresponding product package.

10. The multi-presentational package of claim 8, wherein at least one of the panels on each of the stabilizers includes an outward facing surface, which includes information about the corresponding product package.

11. The multi-presentational package of claim 1, wherein each stabilizer is a circumferential, sleeve-like stabilizer, which substantially encircles the corresponding product package.

12. The multi-presentational package of claim 11, wherein each of the circumferential, sleeve-like stabilizers includes an outward facing surface, which includes information about the corresponding product package.

13. The multi-presentational package of claim 1, wherein the multipresentational package includes four product packages.

14. The multi-presentational package of claim 1, including a support member disposed between at least some of the product packages.

15. The multi-presentational package of claim 1, including a top cap.

16. The multi-presentational package of claim 1, wherein the multipresentational package is stackable.

* * * * *